US007341150B2

(12) United States Patent
Fäller

(10) Patent No.: US 7,341,150 B2
(45) Date of Patent: Mar. 11, 2008

(54) NEEDLE PACKAGE AND NEEDLE POUCH, AS WELL AS PACKAGING METHOD

(75) Inventor: Armin Fäller, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 463 days.

(21) Appl. No.: 10/762,576

(22) Filed: Jan. 23, 2004

(65) Prior Publication Data

US 2004/0163993 A1 Aug. 26, 2004

(30) Foreign Application Priority Data

Feb. 7, 2003 (DE) ..... 103 05 017

(51) Int. Cl.
*B65D 69/00* (2006.01)

(52) U.S. Cl. ..... 206/380; 206/574

(58) Field of Classification Search ..... 206/380, 206/381, 382, 227, 574, 63.3
See application file for complete search history.

(56) References Cited

U.S. PATENT DOCUMENTS

| | | | | |
|---|---|---|---|---|
| 121,860 A | | 12/1871 | Evans | |
| 969,141 A | * | 8/1910 | Hankins | 206/382 |
| 1,391,288 A | | 9/1921 | Waldes | |
| 1,634,096 A | * | 6/1927 | Haile | 206/382 |
| 2,126,444 A | | 8/1938 | Bollinger, Jr. | |
| 2,230,849 A | | 2/1941 | Salfisberg | |
| 2,713,937 A | * | 7/1955 | Schneider | 206/380 |
| 2,771,187 A | * | 11/1956 | Haile | 206/380 |
| 3,014,582 A | * | 12/1961 | McGrane | 206/380 |
| 3,507,094 A | | 4/1970 | Coles | |
| 3,985,227 A | * | 10/1976 | Thyen et al. | 206/63.3 |
| 4,386,697 A | * | 6/1983 | Zocher | 206/383 |
| 4,765,473 A | * | 8/1988 | Pavel et al. | 206/380 |
| 5,067,611 A | * | 11/1991 | Hagmann et al. | 206/383 |
| 5,181,610 A | * | 1/1993 | Quick et al. | 206/447 |
| 5,462,166 A | * | 10/1995 | Minton et al. | 206/440 |
| 5,706,950 A | | 1/1998 | Houghton et al. | |

FOREIGN PATENT DOCUMENTS

| | | |
|---|---|---|
| DE | 1 674 694 | 4/1954 |
| DE | 1 051 191 | 2/1959 |
| DE | 1 793 683 | 8/1959 |
| DE | 1 198 731 | 8/1965 |
| DE | 1 435 045 A | 11/1968 |
| DE | G 91 07 473.8 | 8/1992 |
| DE | 296 13 633 U1 | 10/1996 |
| FR | 2 692 867 A1 | 12/1993 |
| GB | 633204 | 12/1949 |

* cited by examiner

*Primary Examiner*—David T. Fidei
(74) *Attorney, Agent, or Firm*—Norman N. Kuntz; Fitch, Even, Tabin and Flannery

(57) ABSTRACT

A needle pouch made of a flexible material, such as paper or plastic, for an orderly packaging of needle sets (6), formed of a strip-shaped portion from the desired material. One end of the strip is folded onto the shanks of the needles and is, at the edges, connected to a mid portion on which the needle set is positioned. The connection is effected between the folded-over pouch portion (15) and the mid portion (14) which are in a face-to-face relationship. The strip-shaped locations of connection bilaterally confine the needle set and thus tightly hold the needles against one another. The needle pouch (2) may be made automatically and in a simple manner and may be adapted in the simplest way to different needle sets.

21 Claims, 6 Drawing Sheets

NEEDLE PACKAGE AND NEEDLE POUCH, AS WELL AS PACKAGING METHOD

CROSS REFERENCE RELATED TO APPLICATION

This application claims the priority of German Patent Application Number DE 103 05 017.5, filed Feb. 7, 2003, the subject matter of which is incorporated herein by reference.

BACKGROUND INVENTION

This invention relates to a method for packaging longitudinally flattened elements, such as knitting machine needles, and further relates to a needle pouch, as well as a needle package for such a needle pouch.

As a rule, knitting machine needles are sold in sizable quantities, and for this reason a plurality of such needles are assembled in a group (hereafter referred to as a needle set) and packaged together. A needle set may be said to consist of a handful of needles as may be repeatedly required by a technician for fitting a needle bed with needles. Such needles have been heretofore delivered in paper bags which had to be previously manufactured and then, upon completion of the needle making, charged with needles and thereafter closed. For very special applications and for ensuring that the needles in the bag do not fall apart, they are first gathered into a bundle, for example, by a rubber band, and then the bundle is inserted into the bag.

The above-outlined packaging mode is relatively expensive and complex. Further, the needles cannot be entirely reliably prevented from falling apart in the paper bag. Such would be the case, for example, when someone removes the rubber band, but subsequently re-introduces the needles into the bag.

In case the needles are placed into the bag loosely, in an un-bundled manner, they fall apart in the bag and may be removed only in a random manner.

It is accordingly an object of the invention to provide a needle package which ensures an orderly accommodation of a needle set with simple technical means.

SUMMARY OF THE INVENTION

The above object generally is achieved with a needle pouch according to the invention that is formed of a paper strip having a down-folded end which is attached to the back side along two strip-shaped regions and which constitutes a pouch portion. Between the two strip-shaped connecting regions a pouch is formed from which a needle set may be removed. By correctly coordinating the pouch width and the width of the needle set with one another, the needles are held in an orderly, mutually parallel-oriented fashion in the needle pouch without any additional securing means. No additional holding means are contained in the needle pouch; the needles are held together solely by being tightly enclosed by the needle pouch.

Such a needle pouch may be manufactured in a particularly simple manner. The making of the needle pouch may be effected while being charged with the needles, In accordance with the method according to the invention, the needle pouch is obtained by longitudinally positioning a needle set on a strip of flexible material, such as a paper strip and subsequently one end of the strip is positioned on the elongated elements, that is, for example, the knitting needles and is attached at the edges to the strip. The connecting regions are preferably of such a width that they extend from the outer edge of the strip to the beginning of the pouch, as a result of which they hold the needle set together. The end of the strip-shaped connecting region which is proximal to the pouch is the respective location where the first and the last needles of the needle set are held.

This type of packaging may be very easily automated, and without changing the width of the flexible strip, it may be utilized for needle sets of different sizes. Stated differently, with a plastic or paper strip of given width and arbitrary length the packaging may be used to wrap most needles. During the packaging process portions having the required length are severed from an endless strip. The length depends from the length of the needles. Very substantial tolerances are admissible, since the lid portion of the strip may be secured to the pouch portion at an arbitrary location.

It is a further advantage that the needle set is held together by the pouch or, more precisely, by the receiving space. The needles or other elongated elements which are in a face-to-face contact with one another at their flat sides, lie in an orderly, aligned fashion in the needle package.

It is a further advantage that upon opening the lid portion, the needle ends are exposed and ready to be grasped, resulting in a simple handling of the package and the needles. The needles may be removed in a sorted and aligned condition. By "aligned" it is meant that the butts of all needles are oriented in a predetermined direction; this improves handling during maintenance of knitting machines.

The lid portion may be secured to the pouch portion, for example, by means of an adhering or adhesive tab. The adhering tab, in addition to its function as a closing flap, may also bear data and furthermore, may serve as a seal to prove genuineness.

The flexible material of the strip may be provided with a corrosion-resistant agent. The strip may be made, for example, of impregnated paper. It is also feasible to make the strip of a plastic material or paper which is impregnated or coated with a plastic material. Plastic-coated paper or plastic material has the advantage that it may be welded, and thus the strip-shaped connecting regions may be obtained by a welding process. It may suffice, for example, to provide solely the connecting regions with a layer, such as a heat-activated adhesive, in which case a bonding may be effected, for example, by applying ultrasound.

The packaging process may be fully automated. This applies particularly also to the possibility of packaging, with one and the same strip, needles of different widths and lengths as well as needle sets of different sizes. The width of the connecting regions may be adapted to the width of the needle set, while the strip length, obtained when the strip is cut, may be adapted to the length of the needle set.

The method according to the invention does not need any pre-made bags, whereby manual work may be dispensed with, resulting in a lowering of packaging costs.

The favorable aligned support of the needles or other elements in the needle pouch ensures a good mechanical protection therefor. The package is particularly simple and can be made in a waste-free manner.

As noted earlier, the connecting regions may be made by gluing or welding. It is also feasible to provide crimped locations, where the face-to-face contacting portions of the strip are connected to one another in a form-fitting manner by pressing sections of one portion into openings of the other portion. Such crimped connections are advantageous because they are made rapidly and inexpensively and are well recyclable.

The needle pouches described above may be combined by means of a suitable box into a needle package which contains one or more needle pouches and thus presents a sizable needle supply. The boxes are preferably mechanically resistant plastic boxes having a parallelepipedic inner space. Their bottom is rectangular and corresponds in size approximately to the size of a needle pouch, that is, to the size of its rectangular contour. In this manner several needle pouches may be placed superposed into the inner space. The orderly accommodation of the needles in the needle pouches ensures that the needle pouches may easily be stacked on top of one another in the predetermined number in the inner space of the box without requiring an excessive height.

Further details of advantageous embodiments appear in the drawing, the description or the dependent claims.

BRIEF DESCRIPTION OF THE DRAWINGS

Several embodiments of the invention are illustrated in the drawing in which.

DETAILED DESCRIPTION OF THE INVENTION

Figure 1:
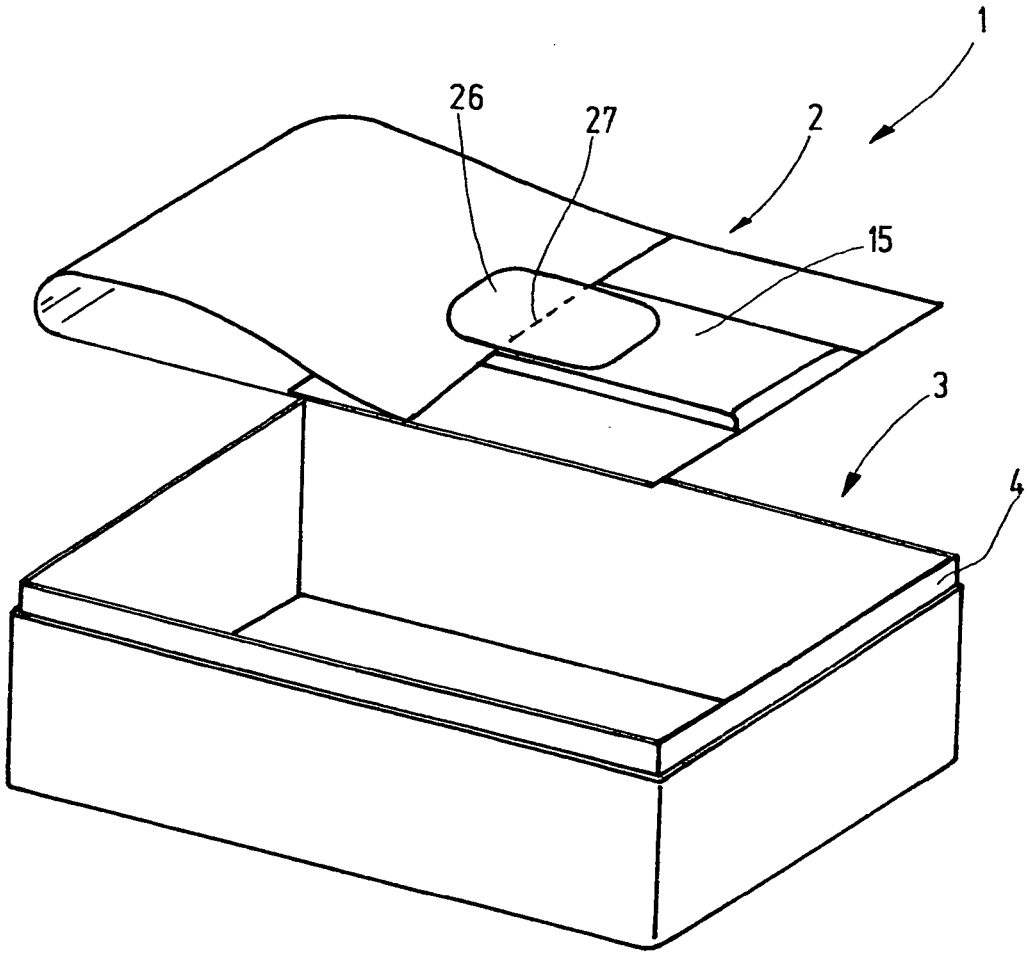
FIG. 1 is a schematic perspective view of a needle package including a needle pouch.

FIG. 1 illustrates a needle package 1 comprising at least one needle pouch 2 (but preferably several needle pouches 2) and a box 3. The box 3 whose lower portion is shown in FIG. 1, is, for example, an upward open plastic box having a circumferentially extending ledge 4 for receiving a lid. The inner space of the box 3 has a base contour of rectangular configuration, corresponding to the rectangular contour of the needle pouch 2.

Figure 2:
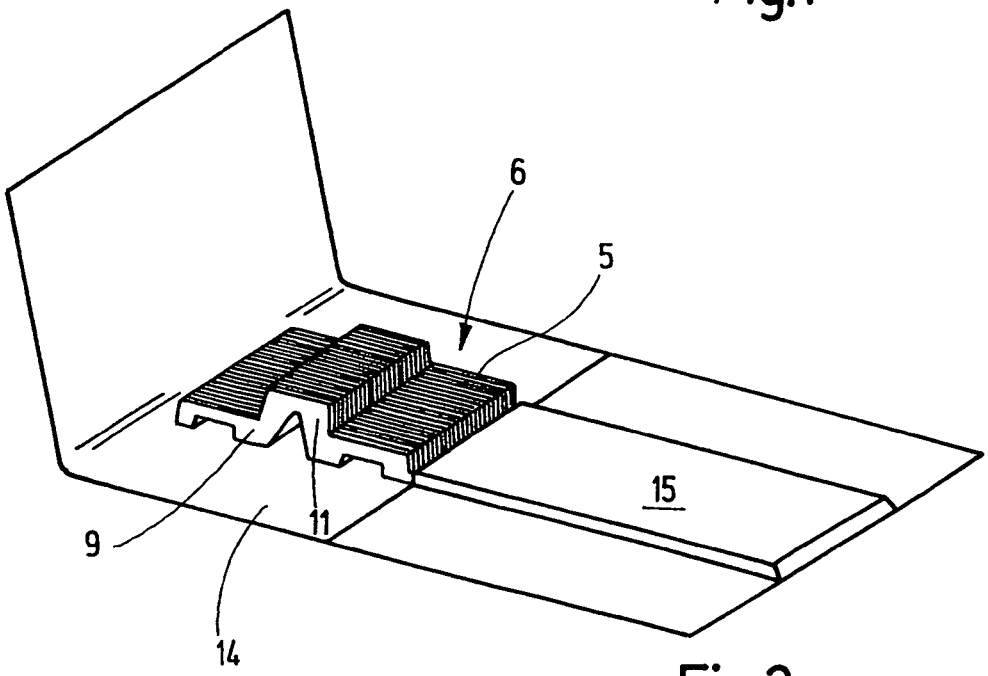
FIG. 2 shows the needle pouch of FIG. 1 in an open state, exposing a needle set ready for removal.
Figure 3:
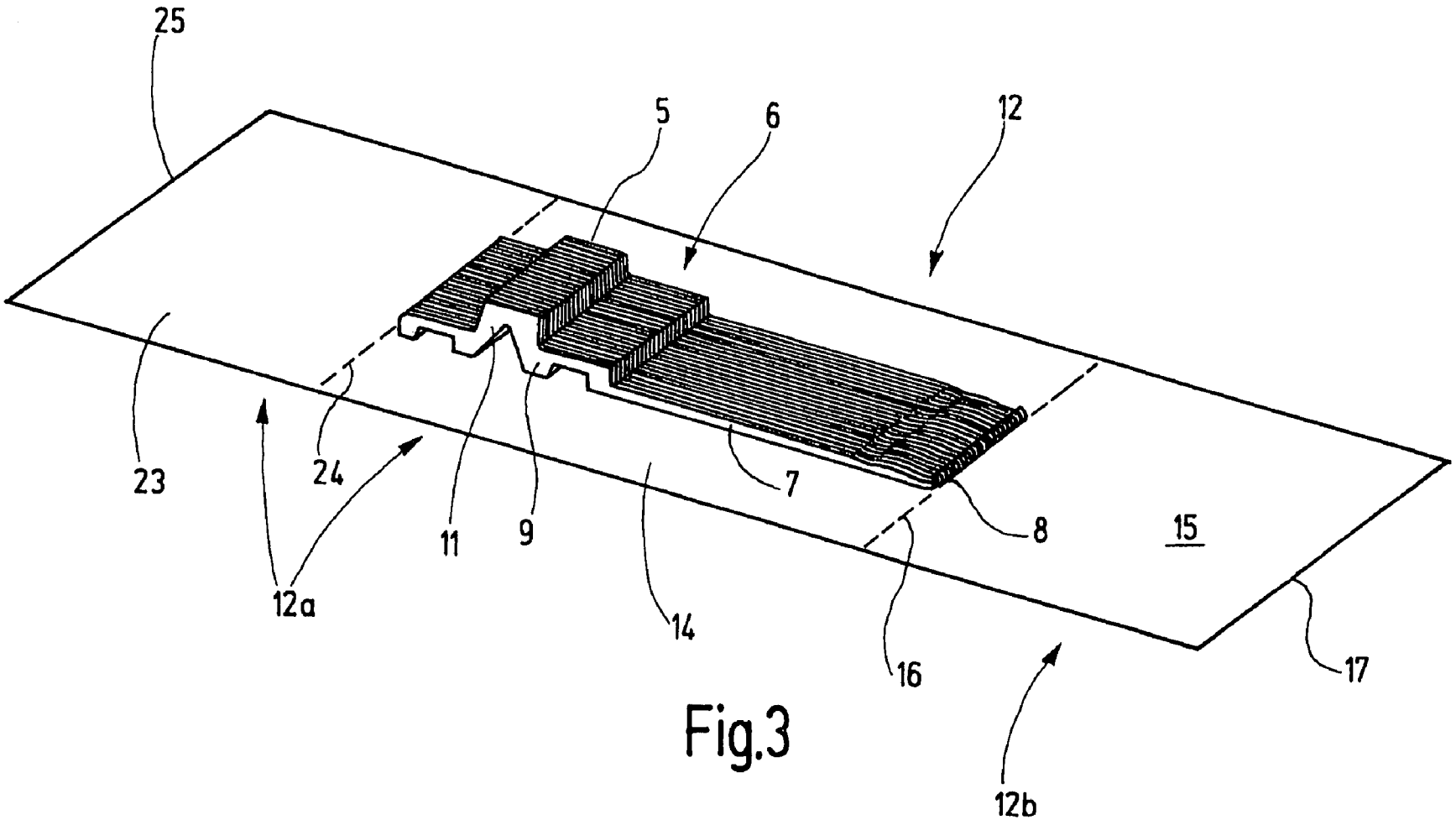
FIG. 3 is a perspective illustration of a needle set during a packaging process.

The needle pouch 2 is shown separately in FIG. 2. It serves as a package for knitting machine needles 5 gathered into a needle set 6. By needle set there is meant a group of knitting machine needles 5 of a predetermined number (for example, 50). The knitting machine needles 5 have flat sides by which they are in a face-to-face engagement with one another, whereby the knitting machine needles 5 lie side-by-side in an orderly fashion. As shown in FIG. 3, each knitting machine needle 5 has an elongated shank 7 which, at an end, carries a hook 8 and further has an end 9 on which a butt 11 is formed. In the region of the end 9 and the butt 11 the height of the knitting machine needle 5 is significantly greater than in the region of the shank 7. As shown in FIGS. 2 and 3, the knitting machine needles 5 have identical contours and lie aligned in a lateral engagement with one another.

Figure 7:
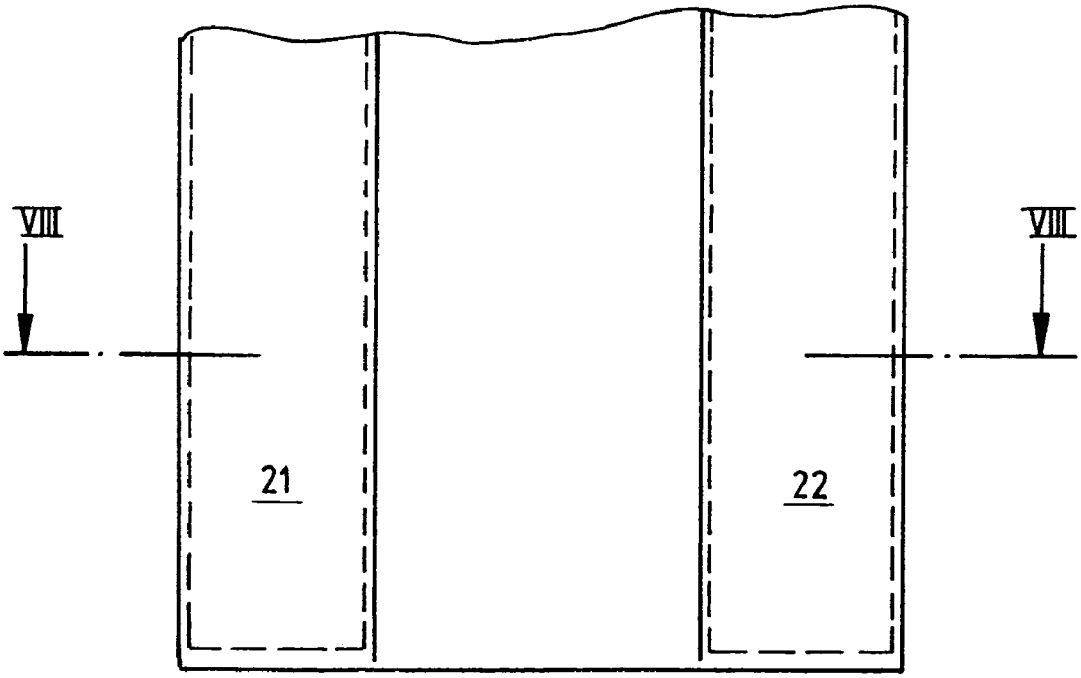
FIG. 7 is a fragmentary top plan view of a needle pouch.

The needle pouch 2 essentially consists of a single strip 12 of flexible material, such as paper, or paper provided with a corrosion-resistant agent, or plastic-coated paper, such as polyethylene-coated paper or plastic. The strip 12 has a width which is significantly greater than the greatest expected width of the needle set 6. The latter is positioned on a mid portion 14 of the strip 12. A pouch portion 15 adjoins the mid portion 14 at a fold line 16. The length of the pouch portion 15 measured from the fold line 16 to the free edge 17 approximately corresponds to the length of a shank 7. As shown in FIG. 2, the pouch portion 15 lies on the shanks 7 of the knitting machine needles 5 and extends laterally from the shanks 7. The pouch portion 15 is secured to the mid portion 14 to form a pouch 18 (FIG. 8) with the mid portion 14. Strip-shaped connecting regions 21, 22 are obtained which are delimited and indicated in broken lines in FIG. 7. The connecting regions may be areas of weld or adhesive.

FIG. 3 further shows a lid portion 23 as part of the strip 12. The lid portion 23 extends from a fold line 24 bordering the ends 9 to a free edge 25 of the strip 12. The distance between the fold line 24 and the edge 25 is greater than the length of the ends 9. In the closed state of the needle pouch 2 the lid portion 23 lies, as shown in FIG. 1, on the pouch portion 15 and is secured thereto, for example, by means of an adhering tab 26. The latter is glued, with one part, to the lid portion 23 and, with another part, to the pouch portion 15. Between the two parts a perforation line 27 may be provided which presents a tear line along which the adhering tab 26 may be severed.

The strip 12 may also be considered as two strips 12*a*, 12*b* which form, in the region of the fold line 16, a single-piece or otherwise interconnected component, wherein the strip 12*a* corresponds to the lid portion 23 and the mid portion 14, whereas the strip 12*b* corresponds to the pouch portion 15.

The adhering tab is designed, for example, solely as a closing member. For opening the needle pouch 2, the adhesive or adhering material of the tab may be sufficiently weak for separating it from the pouch portion 15 without tearing. Preferably, however, the tab 26 additionally serves as a seal proving genuineness, and, for such a purpose, its adhesive or adhering material is so designed that the tab 26 cannot be separated from the pouch portion without breakage. In such a case then, the tab is torn through the perforation line 27 for opening the needle pouch 2.

The above-described needle pouch 2 serves for packaging knitting machine needles 5 as follows:

For packaging the knitting machine needles 5, they are first gathered group-wise into a needle set 6 and then positioned by a machine on a strip 12, made of a desired packaging material, such as paper. The strip 12 may be a part of a very long or endless web or strip adjoining the edge 25. Or, the strip 12 may already have been severed at the edge 25 from such a machine-fed endless strip. Thus, the needle set 6 is placed on the mid portion 14 of the strip 12 in such a manner that the individual needles 5 are aligned approximately parallel to the longitudinal edges of the strip 12 and the hooks 8 stand approximately on the intended fold line 16. The two sides of the needle set are approximately at the same distance from the respective long edge of the rectangular strip 12.

Thereafter, an adhesive is applied to the strip 12, for example, on either side of the shanks 7 of the needle set 6. The adhesive may be, for example, a heat-activated adhesive which becomes viscous under the effect of heat. Then the pouch portion 15 is folded back 180°, whereby the pouch portion 15 lies on the shanks 7 and on those regions of the mid portion 14 which are on either side of the shanks. The pouch portion 15 may be bonded to the mid portion 14 by suitable pressure means, such as rubber rollers; the pouch obtained will be precisely as wide as permitted by the needle set 6. As a result, the needle set 6 is firmly held in the inner space thus obtained, that is, the pouch is precisely of a size so as to tightly surround the needle set 6, whereby the needle set 6 is securely held.

For closing the pouch, all that remains to be done is to fold over the lid portion 23 and to secure the adhering tab 26. The packaging of the knitting machine needles 5 is thus completed. The closed needle pouch 2 may then be deposited into the box 3 as shown in FIG. 1.

Figure 6:
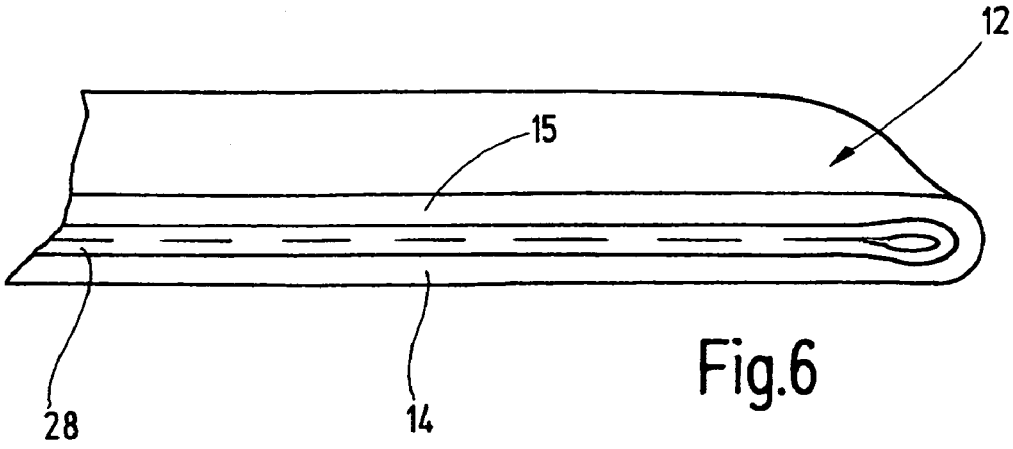
FIG. 6 is a fragmentary side view of a needle pouch on a different scale.

As a departure from the method described above, the adhesive or adhering substance for securing the pouch portion 15 to the mid portion 14 may also be applied to pouch portion 15. As a further modification, for example, a PE-coated paper or a thin plastic sheet may be used as the packaging material, as shown, for example in FIGS. 6 and 7. In such a case the strip 12 is provided with a thin polyethylene layer 28 on its entire surface oriented toward the knitting machine needles 5. In the connecting regions 21, 22 the mid portion 14 and the pouch portion 15 are welded together, for example, by means of pressure and/or heat and/or ultrasound. The polyethylene layer 28 thus forms the bonding agent for forming the pouch 18. It is advantageous in this arrangement that needle sets of arbitrary width may be packaged, without taking into account such width upon application of an adhesive.

Figure 4:
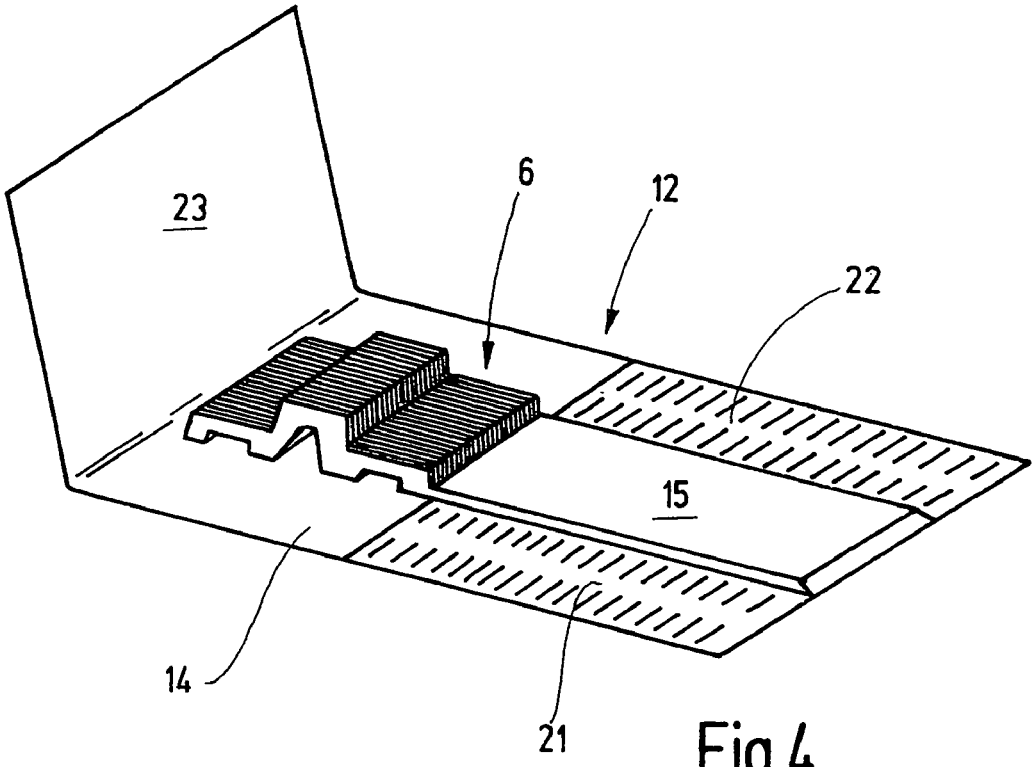
FIG. 4 is a perspective illustration of an opened needle pouch having crimped connections.

A further variant of the invention is illustrated in FIG. 4. According to this embodiment the connecting regions 21, 22 are formed by crimping effected by providing short cuts in the material of the strip 12. The cuts pass through both the pouch portion 15 and the mid portion 14 in the connecting regions 21, 22 and thus produce short webs which are pressed into the respective, face-to-face contacting other parts of the strip 12. As a result, in the connecting regions 21, 22 the pouch portion 15 and the mid portion 14 are mechanically inter-hooked. According to this embodiment an attachment in the connecting regions 21, 22 may be effected without using any auxiliary material. An adaptation to different widths of the needle sets 6 is feasible simply by suitably adjusting the crimping device.

Figure 5:
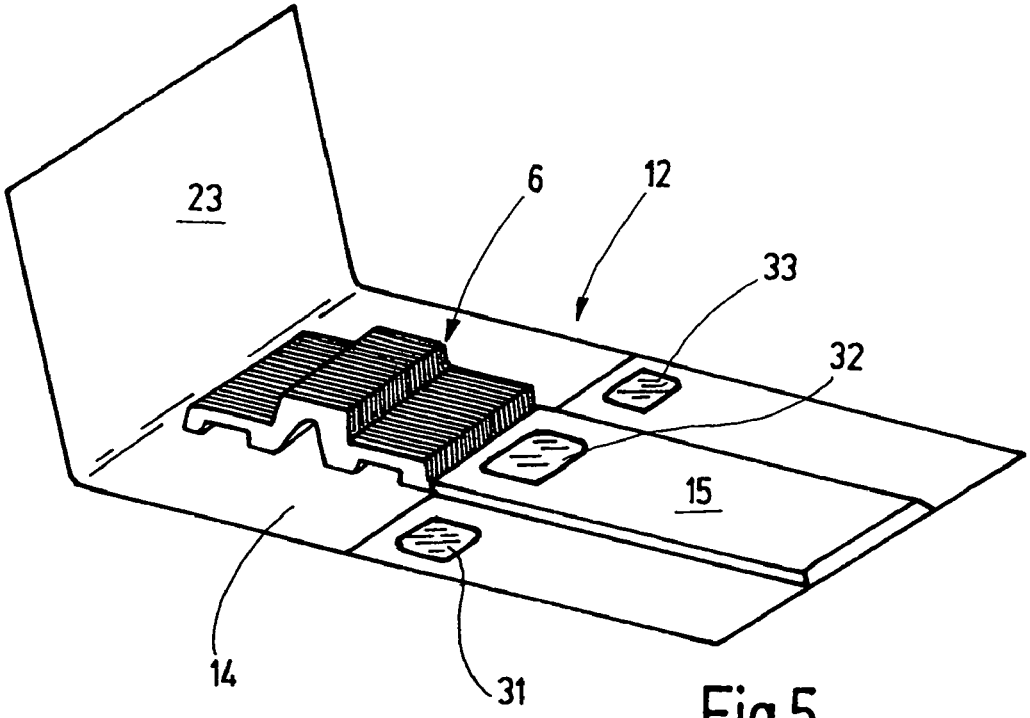
FIG. 5 is a perspective illustration of an opened needle pouch having adhering closures.

As shown in FIG. 5, instead of the adhering tab 26 a different type of closure may be used. For example, to the pouch portion 15, at one or more locations, an adhering or adhesive substance 31, 32, 33 may be applied which serves for securing the lid portion 23.

Figure 9:
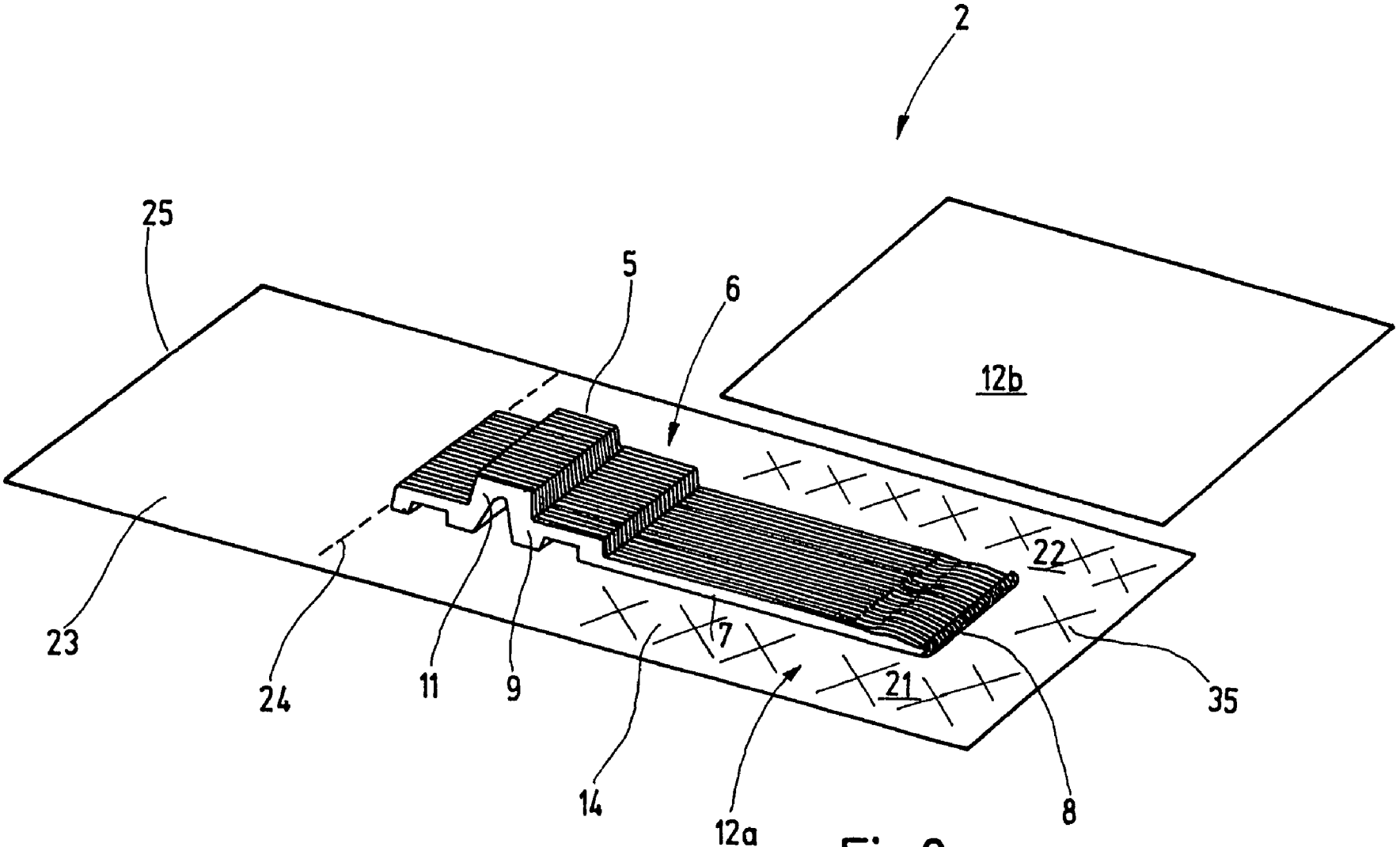
FIG. 9 is a perspective illustration of a needle set during a packaging process utilizing an alternative embodiment of the needle pouch.

FIG. 9 illustrates an alternative embodiment of the needle pouch 2 during its manufacture. The description supplied in conjunction with FIG. 3 applies, with the exception of differences now to be set forth.

Figure 8:
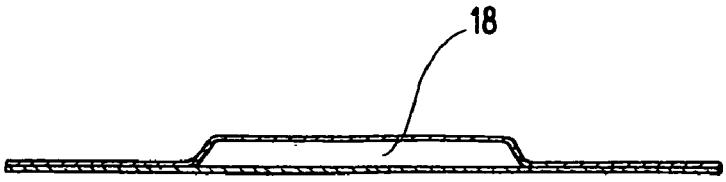
FIG. 8 is a sectional view of a needle pouch, taken along line VIII-VIII of FIG. 7.

The strip 12*b* is separate from the strip 12*a*, so that the needle pouch 2 is made from two strips 12*a* and 12*b*, rather than from a single strip 12. The fold line 16 is omitted and instead the strip 12*a* extends slightly beyond the hooks 8 and leaves free a strip-shaped region to which an adhesive is applied to thus obtain a strip-shaped connecting region 35. The latter adjoins the connecting regions 21, 22 and forms therewith an area shaped as a closed "U". The strip 12*b* may be positioned from above on the connecting regions 21, 22, 35 and pressed firmly thereon. As a result, once again the pouch 18 shown in section in FIG. 8 is obtained.

Figure 10:
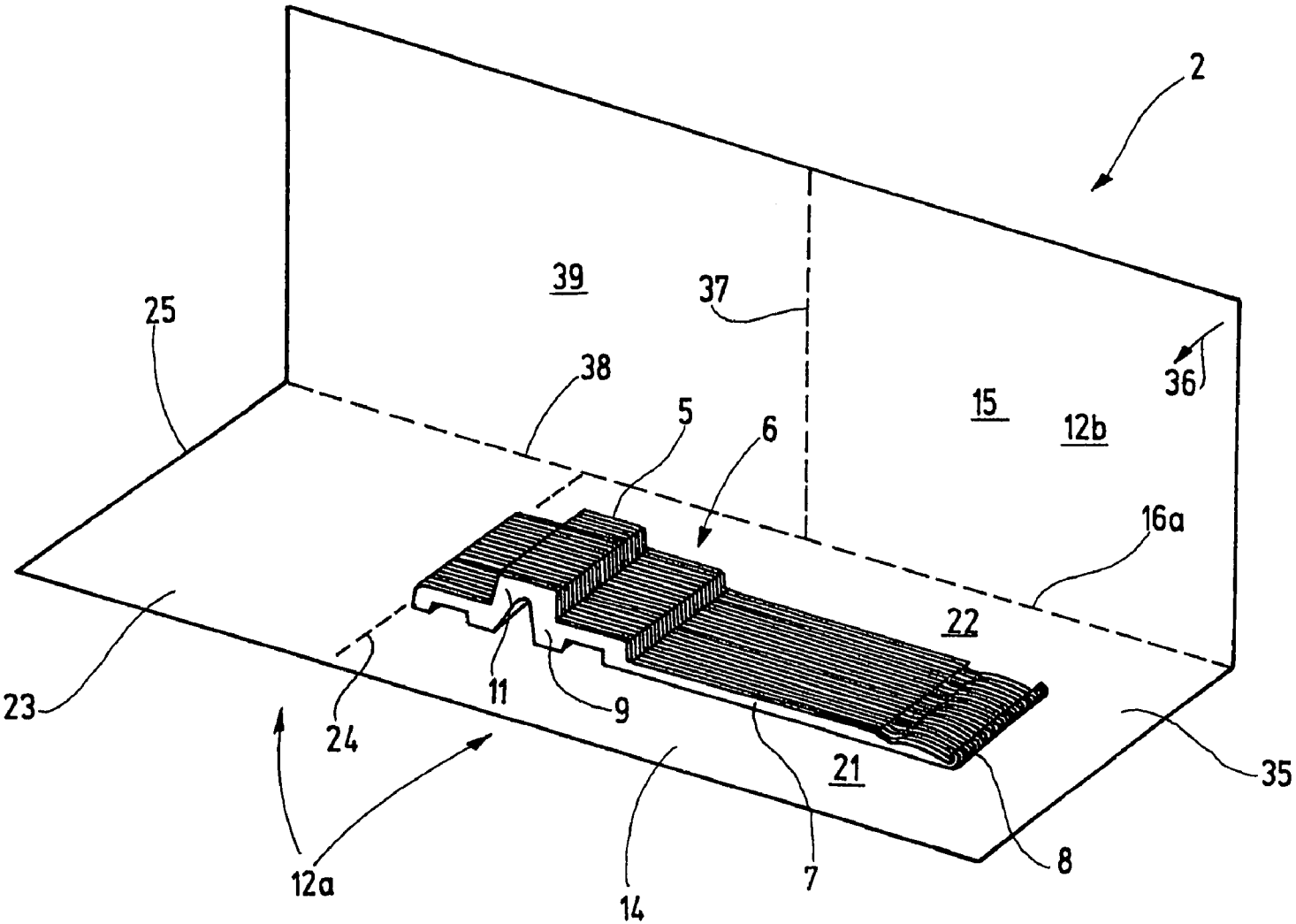
FIG. 10 is a perspective illustration of a needle set during a packaging process utilizing a further alternative embodiment of the needle pouch.

A further embodiment of the needle pouch 2 according to the invention is shown in FIG. 10. In this embodiment the strip 12 has a length which corresponds approximately to the length of the strip 12*a* of FIG. 9. The portion extending beyond the hooks 8 is sufficiently wide to obtain the connecting region 35 and is not folded over. The width of the strip 12 is approximately twice the width of the strip 12 of FIG. 9 or 3. The fold line 16*a* extends parallel to the needles of the needle set 6 and replaces the long edge of the strip 12. As a result, a pouch portion 15 is formed which is folded onto the needle set 6 for closing the needle pouch 2, as indicated by the arrow 36 in FIG. 10. Approximately at the height of that end of the shanks 7 which is distal from the hooks a severing line 37 may be provided, along which a cut is made upon closing the needle pouch 2. A further cut may be provided along a severing line 38 which extends as a linear continuation of the fold line 16*a*. In this manner a separated waste portion 39 is obtained which is defined by the mutually perpendicular severing lines 37, 38 and which is discarded. The pouch portion 15 is secured to the connecting regions 21, 22, 35 by one of the earlier-described techniques.

As an alternative to the embodiment according to FIG. 10, the connecting region 22 may be dispensed with by positioning the fold line 16*a* directly on the needle set 6. In such a case the package obtained is asymmetrical, but narrower. In both cases the pouch portion 15 forms a second strip 12*b* integrally connected with the first strip 12*a*.

A needle pouch made of a flexible material, such as paper or plastic, for an orderly packaging of needle sets 6 is made from a strip-shaped portion of the desired material. One end of the strip-shaped portion is folded over the shanks of the needles and is attached at the edges to the mid portion, on which the needle set is positioned. The connection is effected face-to-face between the down-folded pouch portion 15 and the mid portion 14. The strip-shaped locations of connection bilaterally closely confine the needle set and thus tightly hold the needles against one another. The needle pouch 2 may be made automatically and in a simple manner and is adaptable in the simplest manner to different needle sets.

List of Reference Characters

| | |
|---|---|
| 1 | needle package |
| 2 | needle pouch |
| 3 | box |
| 4 | ledge |
| 5 | knitting machine needles |
| 6 | needle set |
| 7 | shank |
| 8 | hook |
| 9 | end |
| 11 | butt |
| 12, 12a, 12b | strips |
| 14 | mid portion |
| 15 | pouch portion |
| 16, 16a | fold line |
| 17 | edge |
| 18 | pouch |
| 21, 22 | connecting regions |
| 23 | lid portion |
| 24 | fold line |
| 25 | edge |
| 26 | adhering tab |
| 27 | perforation line |
| 28 | polyethylene layer |
| 31, 32, 33 | adhesive |
| 34 | region |

-continued

| List of Reference Characters | |
|---|---|
| 35 | connecting region |
| 36 | arrow |
| 37, 38 | severing line |
| 39 | waste portion |

The invention claimed is:

1. An arrangement including a set of knitting machine needles, each having a shaft that is provided with a hook at one end, an opposite end portion provided with a butt, and having planar side surfaces, and, a needle pouch for the knitting machine needles, comprising a first strip of flexible material; with a width of the first strip being greater than a width of the needle set and with a length of the first strip being greater than a length of a knitting machine needle, a second strip of flexible material; with a width of the second strip being greater than a width of the needle set, and with the second strip lying face-to-face on a portion of a flat-disposed first strip, and at least two strip-shaped connecting regions wherein the second strip is connected to the first strip to form a pouch there between, with the dimensions of the formed pouch being such that the knitting needles of the needle set are clamped together and held in parallel relationship with abutting side surfaces in alignment by the fit of the pouch and with the butt containing opposite end portions of the needles being free to be grasped by hand.

2. The arrangement defined in claim 1, wherein a lid portion of the first strip is folded over the second strip and the pouch and/or is releasably secured to at least one of the second strip and to the pouch.

3. The arrangement defined in claim 1, wherein the flexible material from which the first and second strips is made, is paper.

4. The arrangement defined in claim 1, wherein the flexible material from which the first and second strips is made, is a plastic.

5. The arrangement defined in claim 1, wherein the flexible material from which the first and second strips is made, is a laminated material.

6. The arrangement defined in claim 1, wherein the first strip and the second strip constitute a coherent strip and adjoin one another along a fold line.

7. The arrangement defined in claim 1, wherein the first strip and the second strip are regions of one and the same coherent strip.

8. The arrangement defined in claim 6, wherein the fold line extends transversely to the longitudinal direction of the strip from one edge to another edge thereof.

9. The arrangement defined in claim 6, wherein the fold line is parallel to the longitudinal direction of the first strip.

10. The arrangement as defined in claim 1, wherein the connecting regions are adhesive locations.

11. The arrangement as defined in claim 1, wherein the connecting regions are weld locations.

12. The arrangement as defined in claim 1, wherein the connecting regions are crimped locations.

13. The arrangement as defined in claim 1, wherein the connecting regions border the edge of the strip and the pouch is enclosed between the two connecting regions.

14. The arrangement as defined in claim 1, wherein the width of the pouch equals the width of the needle set.

15. The arrangement as defined in claim 1, wherein the length of the pouch equals the length of the needle shanks.

16. The arrangement as defined in claim 1, wherein an adhesive location is provided for releasably securing the lid portion.

17. The arrangement as defined in claim 1, wherein an adhering tab or a seal is provided for releasably securing the lid portion.

18. The arrangement as defined in claim 1, wherein the length of the second strip is less than the length of a knitting machine needle.

19. A needle package comprising a needle pouch as defined in claim 1 and a box for receiving the needle pouch.

20. The needle package as defined in claim 19, wherein the box is a plastic box.

21. The needle package as defined in claim 19, wherein the box has an inner space, whose base outline corresponds to the outer contour of the needle pouch.

* * * * *